US008998371B2

(12) United States Patent
Nakano et al.

(10) Patent No.: US 8,998,371 B2
(45) Date of Patent: Apr. 7, 2015

(54) IMAGE FORMING APPARATUS

(71) Applicants: Tomoaki Nakano, Kanagawa (JP); Kazuyoshi Matsumoto, Tokyo (JP); Shingo Masaoka, Kanagawa (JP); Yasukazu Kitamura, Kanagawa (JP); Namio Ogihara, Kanagawa (JP); Yoshimitsu Ogura, Kanagawa (JP); Makoto Kikura, Kanagawa (JP); Kazuyoshi Kondo, Tokyo (JP); Yuuzoh Obata, Tokyo (JP); Norikazu Yanase, Kanagawa (JP); Yoshinori Uchino, Kanagawa (JP); Gaku Hosono, Kanagawa (JP); Takao Otsuka, Kanagawa (JP); Seiya Ogawa, Kanagawa (JP); Yuuichiroh Tsujiguchi, Kanagawa (JP); Masashi Ohnishi, Kanagawa (JP)

(72) Inventors: Tomoaki Nakano, Kanagawa (JP); Kazuyoshi Matsumoto, Tokyo (JP); Shingo Masaoka, Kanagawa (JP); Yasukazu Kitamura, Kanagawa (JP); Namio Ogihara, Kanagawa (JP); Yoshimitsu Ogura, Kanagawa (JP); Makoto Kikura, Kanagawa (JP); Kazuyoshi Kondo, Tokyo (JP); Yuuzoh Obata, Tokyo (JP); Norikazu Yanase, Kanagawa (JP); Yoshinori Uchino, Kanagawa (JP); Gaku Hosono, Kanagawa (JP); Takao Otsuka, Kanagawa (JP); Seiya Ogawa, Kanagawa (JP); Yuuichiroh Tsujiguchi, Kanagawa (JP); Masashi Ohnishi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/200,295

(22) Filed: Mar. 7, 2014

(65) Prior Publication Data

US 2014/0253623 A1 Sep. 11, 2014

(30) Foreign Application Priority Data

Mar. 11, 2013 (JP) ..... 2013-048380
Oct. 2, 2013 (JP) ..... 2013-207701

(51) Int. Cl.
*B41J 29/38* (2006.01)
*B41J 11/00* (2006.01)
*B41J 3/407* (2006.01)

(52) U.S. Cl.
CPC ..... *B41J 11/0045* (2013.01); *B41J 3/4075* (2013.01); *B41J 11/007* (2013.01)

(58) Field of Classification Search
CPC .. B41J 11/002; B41J 11/0005; B41J 11/0095; B41J 11/007; B41J 11/0085; B41J 13/226
USPC ..... 347/16, 101, 102, 104
See application file for complete search history.

(56) References Cited

U.S. PATENT DOCUMENTS 5,324,024 A 6/1994 Mori et al.
6,224,203 B1 * 5/2001 Wotton et al. ..... 347/101

FOREIGN PATENT DOCUMENTS

JP 5-043104 2/1993
JP 2003-002500 1/2003

(Continued)

OTHER PUBLICATIONS

U.S. Appl. No. 13/950,473, filed Jul. 25, 2013.
U.S. Appl. No. 13/950,867, filed Jul. 25, 2013.
U.S. Appl. No. 14/027,492, filed Sep. 16, 2013.

(Continued)

*Primary Examiner* — An Do
(74) *Attorney, Agent, or Firm* — Cooper & Dunham LLP

(57) ABSTRACT

An image forming apparatus includes an image forming device, a conveyance unit, a correction unit, and an attitude controller. The image forming device forms an image on a printing medium. The conveyance unit is disposed opposing the image forming device to convey the printing medium. The correction unit corrects an attitude of a leading edge of the printing medium sent out from the conveyance unit. The attitude controller controls correction of the attitude of the leading edge of the punting medium performed by the correction unit. The attitude controller determines whether or not the correction of the attitude of the leading edge of the printing medium is to be performed, and causes the correction unit to perform the correction when the attitude controller determines that the correction is to be performed.

10 Claims, 16 Drawing Sheets

(56) References Cited

FOREIGN PATENT DOCUMENTS

| | | |
|---|---|---|
| JP | 2008-239320 | 10/2008 |
| JP | 2009-300656 | 12/2009 |
| JP | 2012-042826 | 3/2013 |

OTHER PUBLICATIONS

U.S. Appl. No. 14/029,016, filed Sep. 17, 2013.
U.S. Appl. No. 14/039,211, filed Sep. 27, 2013.
U.S. Appl. No. 14/045,931, filed Oct. 4, 2013.
U.S. Appl. No. 14/044,071, filed Oct. 2, 2013.

* cited by examiner

| SENSOR OUTPUT V | CORRECTION |
|---|---|
| V<V(th) | NEEDED |
| V≥V(th) | NOT NEEDED |

| SENSOR OUTPUT V | SHIFT OF ATTITUDE REGULATION TAB |
|---|---|
| V<V(th) | NEEDED |
| V≥V(th) | NOT NEEDED |

| SENSOR OUTPUT V | DRIVING OF FAN |
|---|---|
| V<V(th) | ON |
| V≥V(th) | OFF |

| SENSOR OUTPUT V | AIRFLOW AMOUNT OF FAN |
|---|---|
| V<V1 | LARGE |
| V1≤V≤V2 | MIDDLE |
| V2≤V≤V(th) | SMALL |
| V≥V(th) | OFF |

FIG. 15
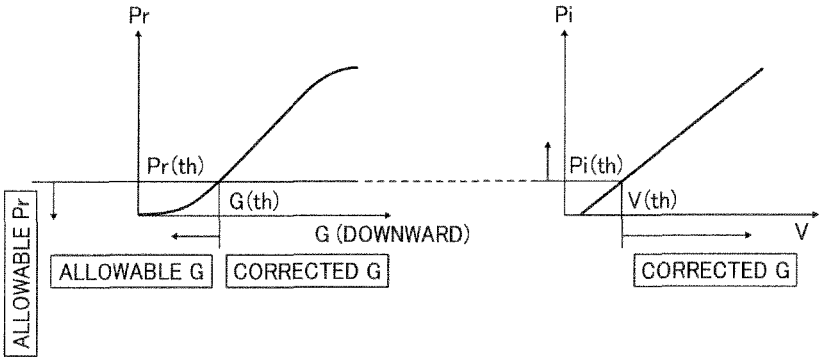
FIG. 16
| OUTPUT OF SENSOR 62A | OUTPUT OF SENSOR 62B | INFLECTION DIRECTION | AIRFLOW DIRECTION OF FAN |
|---|---|---|---|
| L | L | UPWARD | SUCTION |
| H | L | REGULAR | OFF |
| L | H | DOWNWARD | DISCHARGE (AIR BLOW) |
FIG. 17
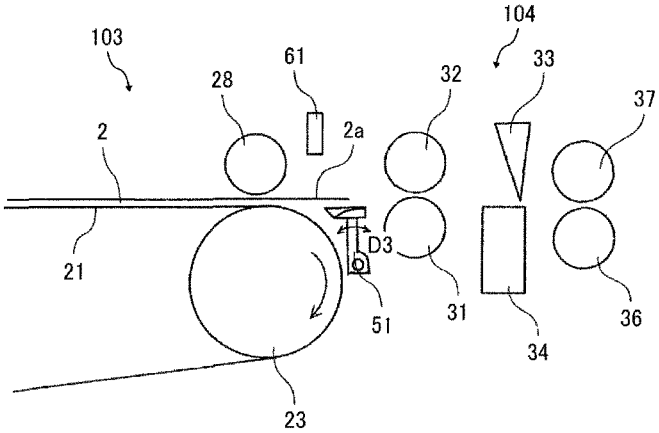

IMAGE FORMING APPARATUS

CROSS-REFERENCE TO RELATED APPLICATIONS

This patent application is based on and claims priority pursuant to 35 U.S.C. §119 to Japanese Patent Application Nos. 2013-048380, filed on Mar. 11, 2013, and 2013-207701, filed on Oct. 2, 2013, in the Japan Patent Office, the entire disclosure of each of which is hereby incorporated by reference herein.

BACKGROUND

1. Technical Field

Embodiments of this disclosure relate to an image forming apparatus.

2. Description of the Related Art

Image forming apparatuses are used as, for example, copiers, printers, facsimile machines, and multi-functional devices having at least one of the foregoing capabilities. As one type of image forming apparatus, there is known an image forming apparatus such as a label printer in which printing is carried out by an image forming device on a printing medium, such as tape and a label sheet without a liner, having an adhesive face and not having release paper attached to the adhesive face (hereinafter also referred to as "linerless label sheet") and the printing medium after the printing is cut into desired lengths to be pieces of printing medium (hereinafter also referred to as "label pieces").

In such an image forming apparatus, since the adhesive face of the printing medium is exposed, it may be difficult to carry out stable conveyance from feed to discharge. For example, the printing medium may be inflected in a direction along a peripheral surface of a rotary body, such as a roller, forming a conveyance unit, at a position at which the printing medium having an image formed thereon is separated from the conveyance unit and sent out to a discharge unit. As a result, the printing medium may not be sent into the discharge unit.

To retain an attitude of the printing medium, for example, a guide plate is provided to guide the printing medium under the printing medium or a fan is provided to blow air to correct the attitude of the printing medium. Alternatively, when a conveyance belt is used, a separation tab is provided to separate the printing medium from the conveyance belt.

As the apparatus for adjusting the attitude of the printing medium by using the fan in discharging the printing medium, for example, an apparatus is known to constantly generate air flows on a side of an upper face (a face opposite from a side of a conveyance face) of a recording medium to thereby give ifting power to the recording medium (see JP-2008-239320-A).

However, if the air flows are constantly given as described in SP-2008-239320-A, the printing medium may be inflected in an opposite direction when the printing medium is not inflected at a position at which the recording medium is sent out from the conveyance unit, thus adversely reducing conveyance performance.

In addition, if the guide plate and the printing medium having the exposed adhesive face are used, frictional resistance may hamper smooth conveyance. For example, for a structure in which the separation tab is constantly in contact with the conveyance belt, the conveyance belt may be damaged.

BRIEF SUMMARY

In at least one embodiment of this disclosure, there is provided an image forming apparatus including an image forming device, a conveyance unit, a correction unit, and an attitude controller. The image forming device forms an image on a printing medium. The conveyance unit is disposed opposing the image forming device to convey the printing medium. The correction unit corrects an attitude of a leading edge of the printing medium sent out from the conveyance unit. The attitude controller controls correction of the attitude of the leading edge of the printing medium performed by the correction unit. The attitude controller determines whether or not the correction of the attitude of the leading edge of the printing medium is to be performed, and causes the correction unit to perform the correction when the attitude controller determines that the correction is to be performed.

BRIEF DESCRIPTION OF THE DRAWINGS

The aforementioned and other aspects, features, and advantages of the present disclosure would be better understood by reference to the following detailed description when considered in connection with the accompanying drawings, wherein:

FIG. 15 is a chart of a relationship between output of an attitude detector and inflection amount in the fourth embodiment;

FIG. 16 is a table of output of the attitude detector, inflection direction, and direction of air from a fan;

FIG. 17 is a side view of a portion from a conveyance unit to a discharge unit in a fifth embodiment of the disclosure;

Figure 1:
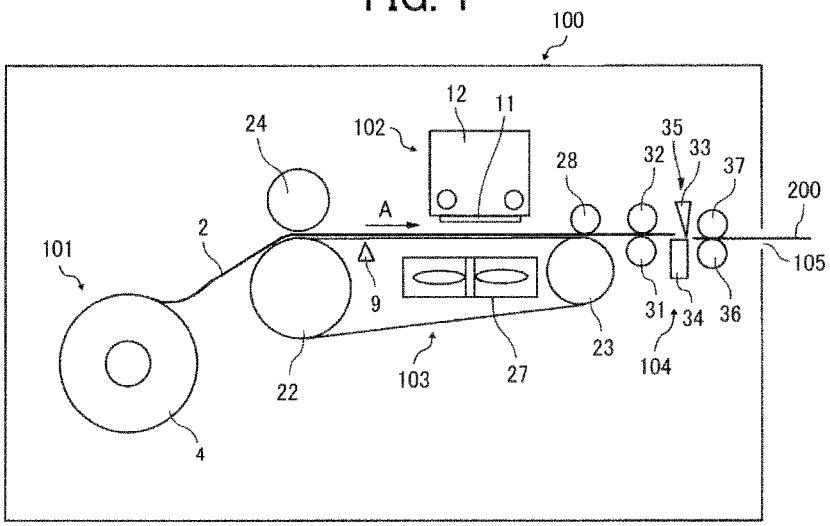
FIG. 1 is a side view of an image forming apparatus according to a first embodiment of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

For example, it will be understood that if an element or layer is referred to as being "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative teens, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

The term "image formation" includes providing not only meaningful images such as characters and figures but meaningless images such as patterns to the medium (in other words, the term "image formation" also includes only causing liquid droplets to land on the medium).

The term "image forming apparatus" in this disclosure includes serial-type image forming apparatuses and line-type image forming apparatuses, unless particularly specified Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present disclosure.

The terminology used herein is for the purpose of describing particular embodiments only and is not intended to be limiting of the present disclosure. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Although the exemplary embodiments are described with technical limitations with reference to the attached drawings, such description is not intended to limit the scope of the disclosure and all of the components or elements described in the exemplary embodiments of this disclosure are not necessarily indispensable to the present invention.

Referring now to the drawings, exemplary embodiments of the present disclosure are described below. In the drawings for explaining the following exemplary embodiments, the same reference codes are allocated to elements (members or components) having the same function or shape and redundant descriptions thereof are omitted below.

First, an image forming apparatus according to a first embodiment of the disclosure is described with reference to FIGS. 1 to 3.

Figure 2:
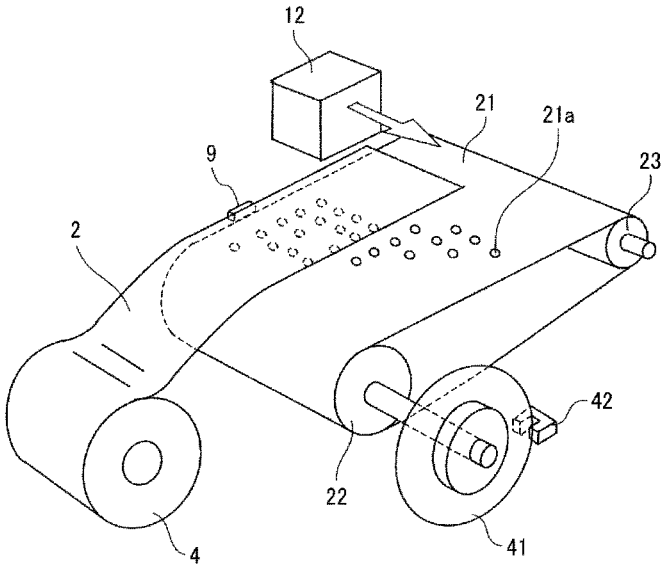
FIG. 2 is a partial perspective view of the image forming apparatus.

FIG. 1 is a side view of the image forming apparatus in the first embodiment. FIG. 2 is a partial perspective view of the image forming apparatus. FIG. 3 is a schematic view of a printing medium in the image forming apparatus.

In an apparatus body 100, the image forming apparatus includes a feed unit 101, an image forming unit 102 serving as an image forming device, a conveyance unit 103 serving as a conveyance device, and a discharge unit 104 serving as a sheet discharge unit.

A roll body 4 is a linerless label sheet formed by winding a printing medium 2 into a roll and is installed into the feed unit 101.

Figure 3:
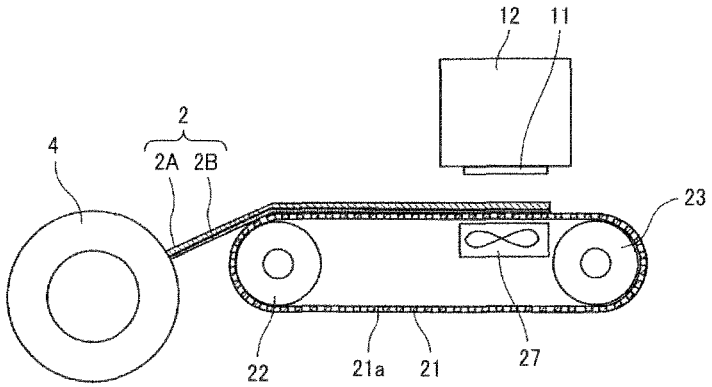
FIG. 3 is a side view of a printing medium in the image forming apparatus.

Here, the printing medium 2 is a continuous body obtained by forming an adhesive layer (hereinafter referred to as "adhesive face") 2B on one face of a medium 2A on which an image can be formed (hereinafter referred to as "printing face") as shown in FIG. 3. The roll body 4 is formed by winding the printing medium 2 into the roll without sticking liner (release paper, separator) to the adhesive face 2B of the printing medium 2.

The image forming unit 102 includes a carriage 12 mounting a recording head 11 serving as a liquid ejection head to eject liquid droplets to the printing medium 2. The carriage 12 is supported by a guide member to be reciprocally movable back and forth along a direction perpendicular to a feeding direction (a direction indicated by arrow A in FIG. 2) of the printing medium 2.

The recording head 11 is a head having two nozzle rows. In this embodiment, two recording heads 11 are used to eject ink droplets of respective colors, i.e., black (K), cyan (C), magenta (M), and yellow (Y) from four nozzle rows. However, the recording head is not limited to the above-described configuration and, for example, a line-type head can be used.

The image forming unit 102 is not limited to the form of the liquid ejection heads and it is possible to use different types of image forming devices to carry out contact or non-contact image formation.

As the conveyance unit 103, a protection belt 21 as a conveyance belt which is an adhesive-face protection member formed in an endless belt shape is disposed below the recording heads 11. The protection belt 21 is looped over a conveyance roller 22 serving as a rotary body and a follow roller 23 to be able to circulate.

A pressure roller 24 is disposed to face the conveyance roller 22. Paired rotary bodies (here, paired rollers) including the conveyance roller 22 and the pressure roller 24 form the conveyance device to sandwich the printing medium 2 and the protection belt 21 which is the adhesive-face protection member together and conveying them to an image formation area for image formation by the recording head 11. Here, the printing medium 2 is conveyed with the adhesive face of the printing medium 2 supported on the protection belt 21.

By using this conveyance device, it is possible to prevent a conveyance error due to adhesion of the adhesive face 2*b* on a conveyance path to convey the printing medium and instability of the conveyance due to increase in conveyance resistance.

In the protection belt 21, many suction holes 21*a* are formed. A suction fan 27 which is a suction unit to suck the printing medium 2 toward a surface (conveyance face) of the protection belt 21 through the suction holes 21*a* is disposed inside the protection belt 21 to face the recording heads 11 of the image forming unit 102. Here, although the printing medium 2 is attracted to the protection belt 21 by suction, the attraction is not necessarily carried out by suction but may be carried out by electrostatic force.

Moreover, a spur roller 28 is disposed to face the follow roller 23.

An encoder wheel 41 is mounted to a shaft of the conveyance roller 22 and an encoder sensor 42 to read the encoder wheel 41 forms a sub-scanning encoder.

As the discharge unit 104, an intermediate roller 31 to convey the printing medium 2 sent out from the protection belt 21 and a spur roller 32 facing the intermediate roller 31 are disposed on a downstream side of the protection belt 21 in a conveyance direction of the printing medium 2. On a downstream side of the intermediate roller 31 and the spur roller 32 is disposed a cutter unit 35 serving as a cutting unit including a cutter 33 to cut the printing medium 2 into predetermined lengths to obtain pieces of printing medium (label pieces) 200 and a receiving table 34. The cutter unit 35 cuts the printing medium 2 by moving the cutter 33 in a main scanning direction.

A discharge roller 36 is disposed on a downstream side of the cutter unit 35 in the conveyance direction of the printing medium 2. A spur roller 37 is disposed to face the discharge roller 36. The label pieces 200 obtained by cutting by the cutter unit 35 are sent out to a discharge port 105 by the discharge roller 36 and the spur roller 37, and retained.

Here, surfaces of the intermediate roller 31 and the discharge roller 36 to retain the label pieces 200 have been subjected to, for example, non-adhesive processing (processing to prevent adhesion of the adhesive faces) so that adhesive faces 2*b* of the label pieces 200 can peel off. In such a case, the intermediate roller 31 and the discharge roller 36 themselves can be made of separable material relative to that adhesive faces 2*b* of the label pieces 200.

In the image forming apparatus formed in this manner, to form an image on the printing medium 2, the roll body 4 is installed into the feed unit 101 and the printing medium 2 is pulled out while the pressure roller 24 is caused to recede to a position away from the conveyance roller 22.

Then, the printing medium 2 is caused to pass between the conveyance roller 22 and the pressure roller 24, the pressure roller 24 is moved in such a direction as to pressurize the printing medium 2 and the protection belt 21, and the printing medium 2 and the protection belt 21 are sandwiched together between the conveyance roller 22 and the pressure roller 24.

After that, by driving the conveyance roller 22 for rotation, the printing medium 2 is conveyed while the adhesive face 2*b* is protected by the protection belt 21 and a desired image is formed by the recording heads 11 of the image forming unit 102.

The protection belt 21 peels off the printing medium 2 on which the image is formed, only the printing medium 2 is sent to the discharge unit 104 and cut at desired positions by the cutter unit 35 into the label pieces 200, and the label pieces 200 are retained between the discharge roller 36 and the spur roller 37 in such a manner that the label pieces 200 can be pulled out of the discharge port 105 of the apparatus body 100.

Next, a correction unit and an attitude detector in the image forming apparatus are described with reference to FIG. 4.

Figure 4:
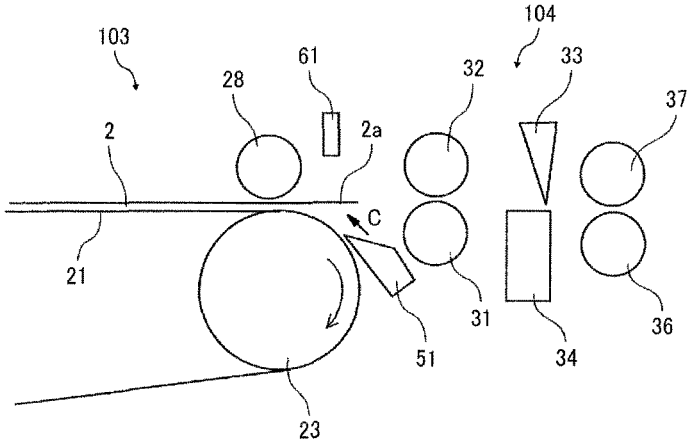
FIG. 4 is a side view of a portion from a conveyance unit to a discharge unit, a correction unit, and an attitude detector of the image forming apparatus.

FIG. 4 is a side view of the portion from the conveyance unit to the discharge unit.

Here, on a printing-medium exit side of the conveyance unit 103, an attitude regulation tab 51 serving as an attitude regulation member, which is the correction unit, is provided to correct an attitude of a leading edge 2*a* (leading edge attitude) of the printing medium 2. The printing-medium exit side of the conveyance unit 103 is a downstream side of the follow roller 23, over which the protection belt 21 is looped, in the conveyance direction of the printing medium.

The attitude regulation tab 51 is provided to be movable forward and backward along a direction indicated by arrow C in FIG. 4 and supports a lower face (here, a face opposite from the image formation face, i.e., a face supported by the protection belt 21) of the printing medium 2 and corrects the attitude of the leading edge of the printing medium 2 by moving in the direction indicated by arrow C.

An attitude sensor 61 as an attitude detector is disposed above the follow roller 23 over which the protection belt 21 is looped. The attitude sensor 61 is formed by a reflective photosensor, for example.

Figure 5:
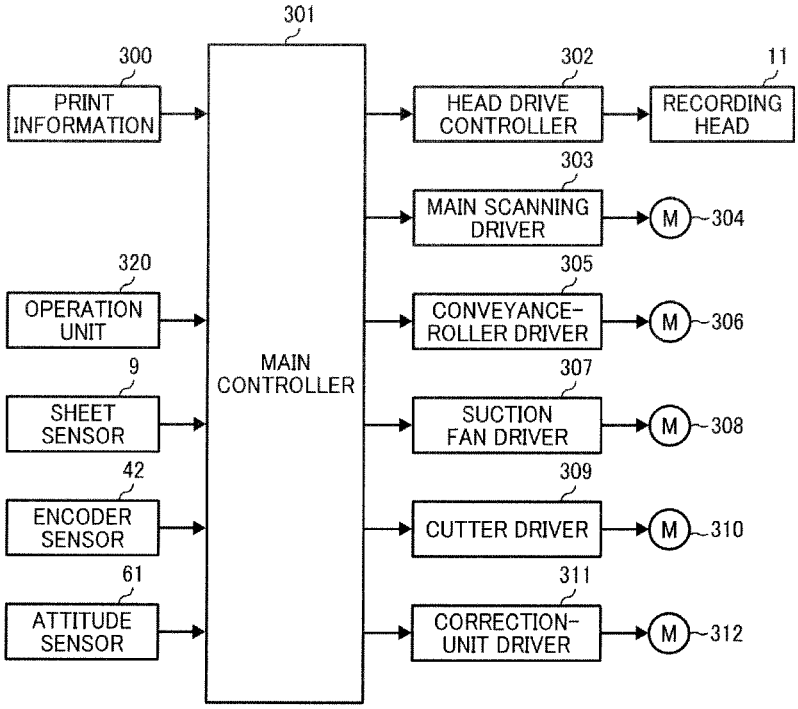
FIG. 5 is a block diagram of a controller of the image forming apparatus.

Next, a general outline of a controller of the image forming apparatus is described with reference to FIG. 5.

The controller includes a main controller 301 also functioning as an attitude controller according to embodiments of the disclosure, a head drive controller 302, a main-scanning driver 303, a conveyance-roller driver 305, a suction-fan driver 307, a cutter driver 309, a correction-unit driver 311, and the like.

The main controller 301 is formed by a central processing unit (CPU), a read-only memory (ROM) and a random access memory (RAM), a microcomputer such as an input/output (I/O) unit, a volatile random access memory (VRAM), an application specific integrated circuit (ASIC), and the like.

To the main controller 301, printing information 300 given from a host is input.

In order to form an image according to the printing information 300 on the printing medium 2, the main controller 301 controls driving of a conveyance motor 306 by using the conveyance-roller driver 305 to rotate the conveyance roller 22 to intermittently convey the printing medium 2 while pulling the printing medium 2 out of the roll body 4. The main controller 301 controls driving of a main-scanning motor 304 with the main-scanning driver 303 to cause the carriage 12 to move and scan in the main scanning direction while controlling driving of the recording heads 11 with the head drive controller 302 to cause the recording heads 11 to eject liquid droplets.

At this time, the main controller 301 carries out control with reference to a detection signal from a leading edge sensor 9 to detect the leading edge of the printing medium 2 and carries out feed control of the printing medium 2 based on a read signal from the encoder sensor 42.

While the conveyance roller 22 is driven for rotation to send the printing medium 2, a suction-fan motor 308 is controlled for driving with the suction-fan driver 307 to rotate the suction fan 27 to attract the printing medium 2 onto the protection belt 21.

As for the discharge roller 36, drive is transmitted from the conveyance roller 22 to drive the conveyance motor 306 for rotation to thereby rotate the discharge roller 36 as well.

Then, the main controller 301 drives a cutter motor 310 to move the cutter 33 of the cutter unit 35 in the main scanning direction with the cutter driver 309 to cut the printing medium 2, on which the image is formed, into desired lengths, thus obtaining the pieces of printing medium (label pieces) 200.

A control panel (control unit) 320 is connected to the main controller 301.

Furthermore, a detection signal (sensing signal) of the above-described attitude sensor 61 sent out from the protection belt 21 of the conveyance unit 103 is input to the main controller 301. The main controller 301 determines whether or not correction of the printing medium 2 is necessary based on a detection result of the attitude sensor 61. If the correction is necessary, the main controller 301 drives a driving unit (actuator) 312 such as a motor to move the attitude regulation tab 51, which is the correction unit, with the correction-unit driver 311.

Next, inflection of the attitude of the leading edge of the printing medium in the image forming apparatus is described with reference to FIG. 6.

Figure 6:
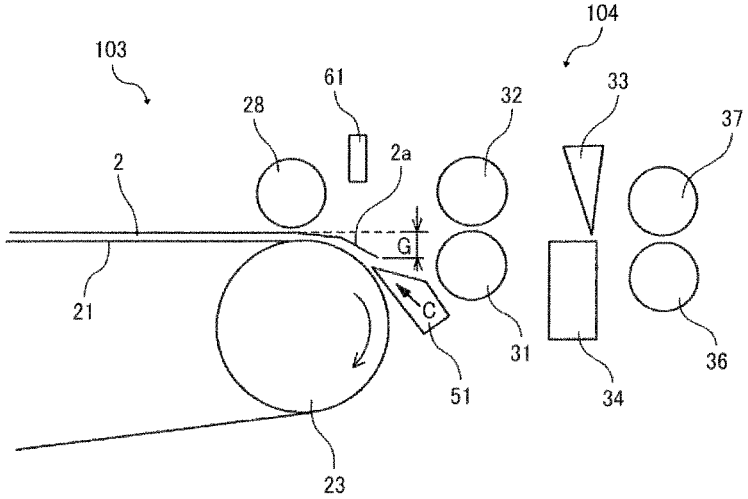
FIG. 6 is a side view of the portion from the conveyance unit to the discharge unit with an example of inflection of an attitude of a leading edge of the printing medium in the image forming apparatus.

FIG. 6 is a side view of a portion from the conveyance unit to the discharge unit with an example of inflection of the attitude of the leading edge of the printing medium in the image forming apparatus.

First, as described above, the printing medium 2 having the image formed thereon is sent out from the protection belt 21 toward the intermediate roller 31.

At this time, since the printing medium 2 is pulled out from the rolled state, the printing medium 2 is curled. If the curled direction is a direction in which the protection belt 21 circulates, the leading edge 2*a* of the printing medium 2 sent out from the protection belt 21 is likely to hang downward (in a rotating direction of the follow roller 23) at a position separated from the protection belt 21 as shown by a solid line in FIG. 6.

In the case in which the printing medium 2 is the linerless label sheet and conveyed with the adhesive face 2*b* retained by the protection belt 21 as in this embodiment, the printing medium 2 is likely to follow the protection belt 21 due to adhesion of the adhesive face 2*b*. As a result, the printing medium 2 is similarly likely to hang downward (in the rotating direction of the follow roller 23) at the position separated from the protection belt 21.

In this manner, if the leading edge 2*a* is hanging downward when the printing medium 2 is sent out from the protection belt 21 toward the intermediate roller 31, the leading edge 2*a* does not reach the intermediate roller 31 to cause a jam.

Hence, in this embodiment, when the attitude sensor 61 detects hanging down (inflection) of the attitude of the leading edge, the attitude regulation tab 51 carries out the correction of the attitude of the leading edge.

Here, a relationship between output of the attitude detector (attitude sensor) and inflection amount of the attitude of the leading edge is described with reference to FIG. 7.

The attitude sensor 61 serving as the attitude detector outputs a sensing output according to a reflected light amount Pr from the leading edge 2*a* of the printing medium 2.

Figure 7:
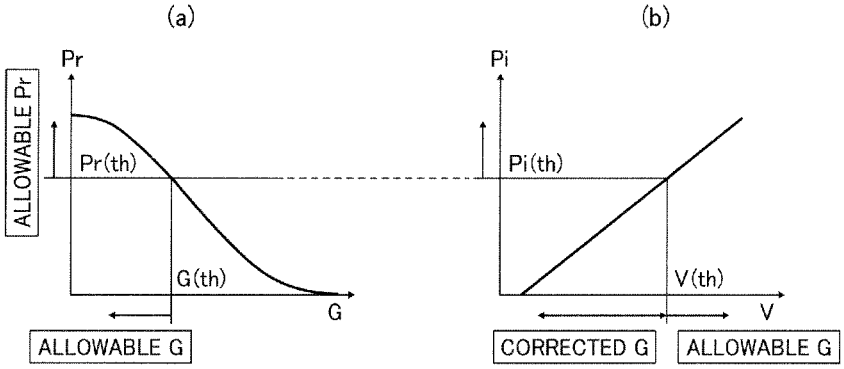
FIG. 7 is a chart of a relationship between output of the attitude detector nd inflection amount of the attitude of the leading edge.

At this time, as shown in (a) of FIG. 7, the reflected light amount Pr from the leading edge 2*a* of the printing medium 2 increases as the leading edge 2*a* of the printing medium 2 approaches a horizontal direction. In other words, the smaller an inflection amount G of the printing medium (see FIG. 6), the larger the reflected light amount Pr, and the larger the inflection amount 6, the smaller the reflected light amount Pr.

Here, as shown in (a) of FIG. 7, a limit value of the inflection amount G which can be allowed in order to send the leading edge 2*a* of the printing medium 2 into between the intermediate roller 31 and the spur roller 32 is defined as an allowable limit value G (th), and the reflected light amount Pr for the allowable limit value G (th) is defined as an allowable limit value Pr (th). When the reflected light amount Pr is the allowable limit value Pr (th) or larger, the inflection amount G is the allowable limit value G (th) or smaller.

On the other hand, as shown in (b) of FIG. 7, the attitude sensor 61 receives reflected light from the leading edge 2*a* of the printing medium 2 and outputs an output voltage (sensor output) V according to an incident light amount (received light amount) Pi. If the incident light amount Pi corresponding to the allowable limit value Pr (th) of the reflected light amount Pr is a limit value Pi (th), the output voltage V corresponding to the incident light amount Pi (th) is an allowable limit value V (th).

Accordingly, if the output voltage V of the attitude sensor 61 is the allowable limit value V (th) or higher, the inflection amount G of the leading edge 2*a* of the printing medium 2 is not greater than the limit value G (th), which is allowed in order to send the leading edge 2*a* into between the intermediate roller 31 and the spur roller 32.

Figures 8, 9, 10:
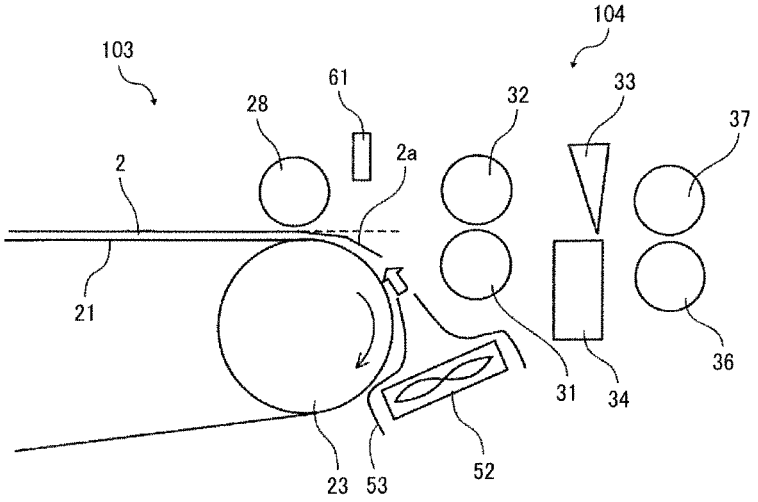
FIG. 8 is a table of the output of the attitude detector and necessity of correction by the correction unit.
FIG. 9 is a table of the output of the attitude detector and operation of an attitude regulation tab.
FIG. 10 is a side view of a portion from a conveyance unit to a discharge unit in a second embodiment of the disclosure.

As shown in FIG. 8, for example, whether or not the correction operation by the correction unit is to be performed (necessary) is determined in advance based on the relationship between the output voltage V and the allowable limit value V (th) of the attitude sensor 61.

Here, because the attitude regulation tab 51 is used as the correction unit, specifically, a table formed by associating necessity of movement of the attitude regulation tab 51 with the relationship between the output voltage V and the allowable limit value V (th) of the attitude sensor 61 is used as shown in FIG. 9.

In other words, if the sensor output V input from the attitude sensor 61 is V≥V(th), the inflection amount G of the leading edge 2*a* of the printing medium 2 is the limit value G (th) or smaller. Therefore, it is not necessary to carry out the correction operation and the correction operation (movement of the attitude regulation tab 51) is not carried out.

On the other hand, if the sensor output V input from the attitude sensor 61 is V<V (th), the inflection amount G of the leading edge 2*a* of the printing medium 2 is over the limit value G (th). Therefore, it is necessary to carry out the correction operation and the correction operation is carried out.

As described above, by providing the attitude sensor 61, it is possible to determine whether the leading edge of the printing medium 2 sent out from the conveyance unit 103 hangs down and is inflected and whether the leading edge can be properly sent to the intermediate roller 31 by comparing the output voltage V and the allowable limit value V (th).

Therefore, as shown in FIG. 9, the table formed by associating the sensor output (output voltage) V and the necessity of the movement of the attitude regulation tab 51 is stored and kept in advance in the ROM or the like in the main controller 301, for example.

Then, the main controller 301 determines (reads out) whether or not the correction operation needs to be carried out by the attitude regulation tab 51 based on the sensor output V input from the attitude sensor 61 and according to the table. At this time, if the correction operation is necessary, the main controller 301 drives the driving unit 312 with the correction-unit driver 311 to move the attitude regulation tab 51 in the direction indicated by arrow C in FIG. 4 to carry out the attitude correction operation to return the leading edge 2*a* of the printing medium 2 into a normal position.

The table does not necessarily have to be used. The allowable limit value V (th) may be kept and the output voltage V of the attitude sensor 61 may be compared with the allowable limit value V (th) (the same applies to the following embodiments).

In this manner, if the attitude of the leading edge of the printing medium 2 is inflected beyond the allowable range, the attitude regulation tab 51 can be moved in the direction indicated by arrow C to return the inflected attitude of the leading edge of the printing medium 2 to the normal position shown with a broken line in FIG. 6 and the printing medium 2 can be conveyed stably.

On the other hand, if the attitude of the leading edge of the printing medium 2 is not inflected beyond the allowable range, the attitude regulation tab 51 is not moved in the direction indicated by arrow C and therefore the attitude regulation tab 51 is not pressed against the leading edge 2*a* of the printing medium 2, which is in the normal position in the first place, to inflect the leading edge 2*a* upward.

Here, if the attitude regulation tab 51 is always in contact with the surface of the protection belt 21, damage such as wear of the protection belt 21 and peeling of a surface coating layer on the adhesive face 2*b* subjected to the non-adhesive processing may occur. By contrast, as described above, by moving the attitude regulation tab 51 toward the protection belt 21 only when the attitude control is necessary, it is possible to prevent damage to the protection belt 21.

Next, a second embodiment of the disclosure is described with reference to FIG. 10.

FIG. 10 is a side view of a portion from a conveyance unit to a discharge unit in the second embodiment.

In this embodiment, a fan 52 which is an air-flow generator (blower) serving as a correction unit is provided. An air flow generated by the fan 52 is guided by an air-flow guide member 53, such as a duct, toward a leading edge 2*a* of a printing medium 2 peeling off from the protection belt 21.

Figures 11, 12, 13:
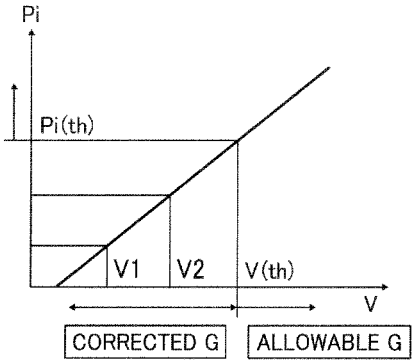
FIG. 11 is a table of output of an attitude detector and operation of a fan in the second embodiment.
FIG. 12 is a chart of a relationship between output of an attitude detector and a plurality of threshold values in a third embodiment of the disclosure.
FIG. 13 is a table of the output of the attitude detector and air volume of a fan.

In the same way as in the first embodiment described above, an attitude sensor 61 is provided and a table formed by associating a sensor output V with driving (ON/OFF) of the fan 52 is stored and kept in advance as shown in FIG. 11.

Then, based on output voltage V from the attitude sensor 61 and according to the table, whether or not correction operation (air blowing) is to be carried out by the fan 52 is determined.

Here, only when the correction operation is necessary, the attitude correction operation in which the fan 52 is turned on to send the air flow to the leading edge 2*a* of the printing medium 2 to blow the leading edge 2*a* up to a normal position indicated by a broken line in FIG. 10 is carried out.

With such a structure using the fan 52, while it is possible to carry out the attitude correction operation without contact with the protection belt 21, the leading edge 2*a* is easily inflected past the normal position to an opposite side by the attitude correction operation, because the position of the leading edge 2*a* is not controlled by physical contact. Therefore, in this structure using the fan 52, detection of the leading edge 2*a* by the attitude sensor 61 and control of the fan 52 based on the detection result are more effective.

Next, a third embodiment of the disclosure is described with reference to FIGS. 12 and 13.

FIG. 12 is a chart of a relationship between output of an attitude detector and a plurality of threshold values in the third embodiment. FIG. 13 is a table of output of the attitude detector and air volume of a fan.

As described above, an incident light amount Pi of an attitude sensor 61 changes and output voltage (sensor output) V of the attitude sensor 61 changes according to an inflection amount of a printing medium 2. Therefore, as shown in FIG. 12, the two threshold values V1 and V2 to be compared with the output voltage V are defined in an area (V(th) area) exceeding an allowable inflection amount.

Then, as shown in FIG. 13, the table formed by associating the output voltage V of the attitude sensor 61 with the air volume of the fan 52 is stored and kept.

In this example in FIG. 13, if the sensor output V is lower than the threshold value V1 (V<V1), the fan 52 is driven with air volume (large) which is a maximum air volume. If the sensor output V is the threshold value V1 or higher and lower than the threshold value V2 (V1≤V<V2), the fan 52 is driven with air volume (middle). If the sensor output V is the threshold value V2 or higher and smaller than an allowable limit value V(th) (V2≤V<Vth), the fan 52 is driven with air volume (small). If the sensor output V is the allowable limit value V(th) or higher (V≥V(th)), the fan 52 is stopped (OFF).

In this manner, by using the fan as a correction unit and increasing the rotation speed of the fan to increase the air volume as the inflection amount of the leading edge of the printing medium increases, it is possible to increase a correction amount as the inflection amount increases, thereby reliably carrying out attitude correction.

Next, a fourth embodiment of the disclosure is described with reference to FIGS. 14A and 14B.

Figure 14A:
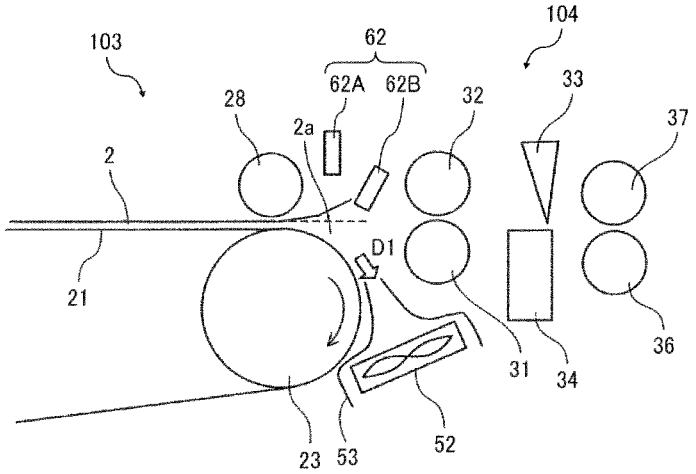
FIGS. 14A and 14B are side views of a portion from a conveyance unit to a discharge unit in a fourth embodiment of the disclosure.
Figure 14B:
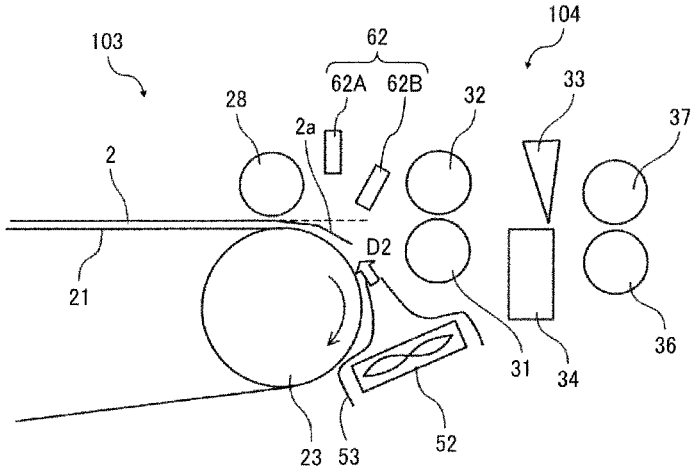

FIGS. 14A and 14B are side views of a portion from a conveyance unit to a discharge unit in the fourth embodiment.

In this embodiment, an attitude sensor 62 including two sensors 62A and 62B is disposed as an attitude detector in order to detect an attitude of a leading edge of the printing medium 2. The sensors 62A and 62B of the attitude sensor 62 are formed by reflective photosensors, for example.

Here, the sensor 62A is disposed in a similar position to the attitude sensor 61 described in the above-described first embodiment.

On the other hand, the sensor 62B is disposed at a position at which an incident light amount on the sensor 62B is large when the leading edge 2*a* of the printing medium 2 is inflected downward.

Next, detection of the attitude by the attitude sensor 62 and attitude control (correction) based on a detection result of the attitude in the fourth embodiment are described with reference to FIGS. 15 and 16.

First, a relationship between inflection amount G and output voltage V of the sensor 62A is the same as that described in FIG. 7 described above.

By contrast, the sensor 62B has such a characteristic that output voltage V is high only when the leading edge 2*a* of the printing medium 2 is inflected as shown in FIG. 15.

Here, V (th) represents a threshold level (threshold value) of output voltage V of each of the sensors 62A and 62B when the inflection of the leading edge 2*a* of the printing medium 2 is allowable. "H" represents V≥V(th). "L" represents V<V (th).

Then, according to a combination of output results of the sensors 62A and 62B, it is possible to determine whether the leading edge 2*a* of the printing medium 2 is in a normal state (an allowable inflection amount or smaller), inflected upward past the allowable inflection amount, or inflected downward as shown in FIG. 16.

As similarly shown in FIG. 16, an operation state (stop, suction, discharge) of the fan 52 is set in advance according to the state (normal, upward inflection, or downward inflection) of the leading edge 2*a* of the printing medium 2.

In other words, when the leading edge 2*a* of the printing medium 2 is inflected upward as shown in FIG. 14A, the fan 52 is rotated in reverse to suck in a direction indicated by arrow D1, thereby returning (correcting) the leading edge 2*a* inflected upward to a normal position.

On the other hand, when the leading edge 2*a* of the printing medium 2 is inflected downward as shown in FIG. 14B, the fan 52 is rotated forward to discharge (blow air) in a direction indicated by arrow D2, thereby returning (correcting) the leading edge 2*a* inflected downward to the normal position.

In this manner, by detecting which of the normal, upward inflection, and downward inflection states the attitude of the leading edge of the printing medium is in, it is possible to carry out more suitable correction operation.

Next, driving timing of the fan when the fan is used as the correction unit as in the second to fourth embodiments is described.

As described above, the air flow generated by the fan 52 is efficiently concentrated on and blown to the leading edge 2*a* of the printing medium 2 by using the air-flow guide member 53 such as a duct.

On the other hand, the image forming unit 102 forms the image by using the liquid ejection head and therefore mist is generated due to the droplet ejection. Much mist is floating in a space including the recording heads 11 and the protection belt 21 and around the space.

Hence, the fan 52 is driven when the leading edge 2*a* of the printing medium 2 is separated from the protection belt 21, and is not driven at other times.

In this way, it is possible to prevent diffusion of the mist by the air flow generated by the fan 52.

For example, the timing when the leading edge 2*a* of the printing medium 2 is separated from the protection belt 21 can be detected based on a feed amount of the printing medium 2.

Next, a fifth embodiment of the disclosure is described with reference to FIGS. 17 and 18.

FIG. 17 is a side view of a portion from a conveyance unit to a discharge unit in the fifth embodiment. FIG. 18 is a perspective view of an attitude regulation tab in the fifth embodiment.

In this embodiment, an attitude regulation tab 54 serving as the attitude regulation member is disposed so as to be swingable along a direction indicated by an arrow D3 in FIG. 17.

Figure 18:
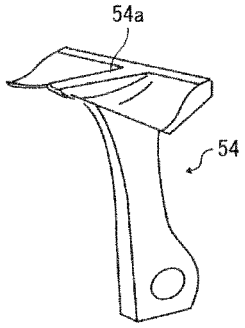
FIG. 18 is a perspective view of an attitude regulation tab in the fifth embodiment.

The attitude regulation tab 54 has a smaller area of a guide 54*a* to be in contact with the printing medium 2, as shown in FIG. 18, thereby preventing sticking of the printing medium 2.

Control of movement of the attitude egulation tab 54 is the same as that in the first embodiment described above.

Next, a sixth embodiment of the disclosure is described with reference to FIG. 19.

Figure 19:
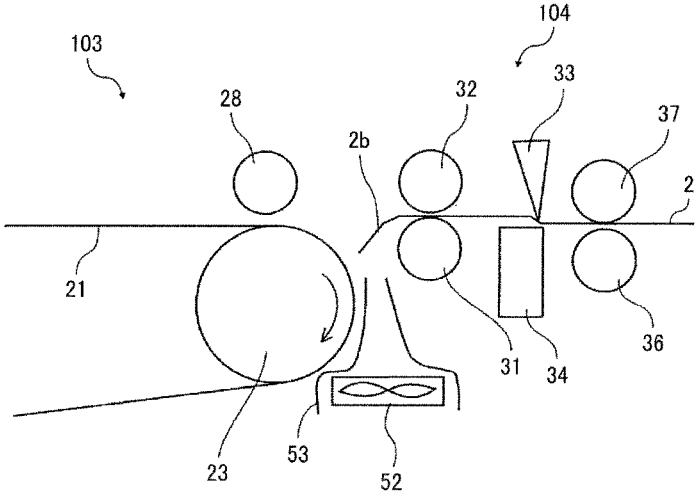
FIG. 19 is a side view of a portion from a conveyance unit to a discharge unit in a sixth embodiment of the disclosure.

FIG. 19 is a side view of a portion from a conveyance unit to a discharge unit in the sixth embodiment In this embodiment, a fan 52 is disposed to jet an air flow upward. The fan 52 then jets the air flow to a rear edge 2*b* of a printing medium 2.

In other words, since a terminal rear edge of the printing medium 2 may also be curled tight, the rear edge 2*b* may be inflected and stick to an intermediate roller 31 when the rear edge 2*b* is separated from the protection belt 21.

Therefore, by blowing the air flow with the fan 52 when the terminal rear edge 2*b* of the printing medium 2 is separated from the protection belt 21 as well, the attitude is corrected and sticking is prevented.

Timing of separation of the rear edge 2*b* of the printing medium 2 from the protection belt 21 can also be detected by a feed amount of the printing medium 2.

Next, a seventh embodiment of the disclosure is described with reference to FIG. 20.

Figure 20:
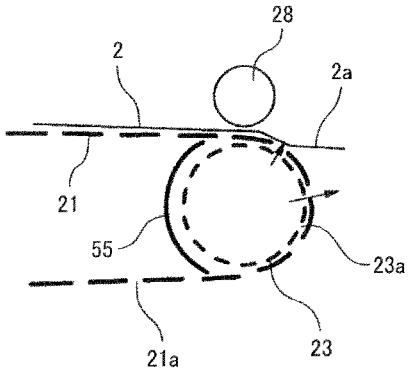
FIG. 20 is a side view of a downstream portion of a conveyance unit in a seventh embodiment of the disclosure.

FIG. 20 is a side view of a downstream portion of a conveyance unit in the seventh embodiment In this embodiment, a downstream follow roller 23, over which a protection belt 21 is looped, is formed as a hollow roller. The downstream follow roller 23 has a hollow inside and a plurality of holes 23*a* communicating the inside with an outside of the follow roller 23. In addition, an air-flow generator, such as a fan, is provided to send an air flow into the follow roller 23.

In this way, when correction of an attitude of a leading edge 2*a* of a printing medium 2 is necessary, air flows are jetted out from the inside of the follow roller 23 through the holes 23*a* and suction holes 21*a* of the protection belt 21, thus allowing correction of the attitude of the leading edge 2*a* of the printing medium 2.

A wall 55 is disposed at a side of the follow roller 23 at which the follow roller 23 is not in contact with the protection belt 21 so that jets of the air flows from the follow roller 23 are concentrated on a side at which the follow roller 23 is in contact with the protection belt 21.

Next, an eighth embodiment of the disclosure is described with reference to FIG. 21.

Figure 21:
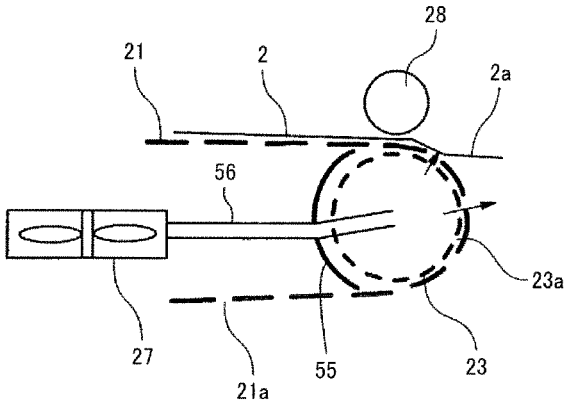
FIG. 21 is a side view of a conveyance unit in an eighth embodiment of the disclosure.

FIG. 21 is a side view of a conveyance unit in the eighth embodiment.

In this embodiment, a suction fan 27 and an inside of a follow roller 23 are connected with a duct 56, and the suction fan 27 is also used as the air-flow generator in the above-described seventh embodiment.

In this case, an opening/closing member such as a shutter member is provided at a position in the duct 56. The opening/closing member is opened and closed according to an attitude detection result from an attitude sensor 61 (or 62) described above, the type of printing medium 2, or the diameter of a roll body 4. In this way, exhaust from the suction fan 27 is sent to the follow roller 23 only when the attitude control (correction operation) is necessary as described above.

With this structure, it is not necessary to separately provide a special fan.

In the structure of this embodiment, it is preferable to secure a state in which the suction fan 27 can exhaust at least in carrying out the attitude control. Hence, the following structure can be employed, for example.

Figure 22:
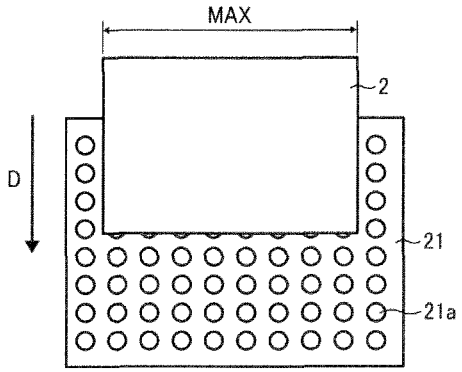
FIG. 22 is a plan view of a first example of securing exhaust of a suction fan in the eighth embodiment.

For example, as shown in FIG. 22, a maximum width MAX of a compatible printing medium and a width of a protection belt are set so that not all of suction holes 21*a* of the protection belt 21 corresponding to a suction area by the suction fan 27 are closed even when a printing medium 2 with the maximum width is conveyed.

Figure 23:
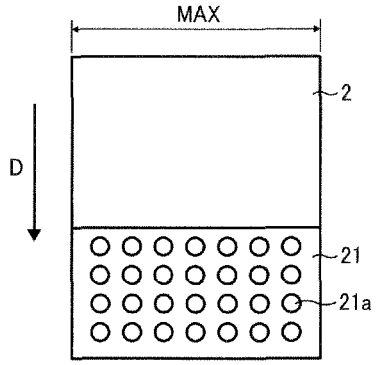
FIG. 23 is a plan view of a second example of securing exhaust of a suction fan in the eighth embodiment.
Figure 24:
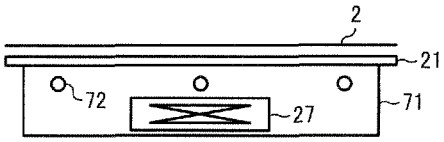
FIG. 24 is a front view of the second example illustrated in FIG. 23.

Alternatively, even when all of the suction holes 21*a* of the protection belt 21 corresponding to the suction area by the suction fan 27 are closed with the printing medium 2 as shown in FIG. 23, suction holes 72 are formed in a structure 71 body housing the suction fan 27 to secure exhausting as shown in FIG. 24.

In the above respective embodiments, the attitude of the leading edge of the printing medium is detected to determine whether to carry out the correction operation. However, the determination is not necessarily limited to the above-described way.

For example, types of printing medium which are subject to inflection of a leading edge may be stored and kept in advance, and the correction operation may be carried out or may not be carried out according to the type of printing medium to be used.

Moreover, the smaller the diameter of the roll body 4, the tighter the curl becomes. Hence, by detecting the diameter (used amount) of the roll body 4, the correction operation may not be carried out until the diameter of the roll body 4 becomes a predetermined diameter or smaller, and the correction operation may be carried out after the diameter becomes the predetermined diameter or smaller.

Such a determination method obviates detection of the attitude of the leading edge and facilitates control of execution or non-execution of the correction operation.

Next, a ninth embodiment of the disclosure is described with reference to FIG. 25.

Figure 25:
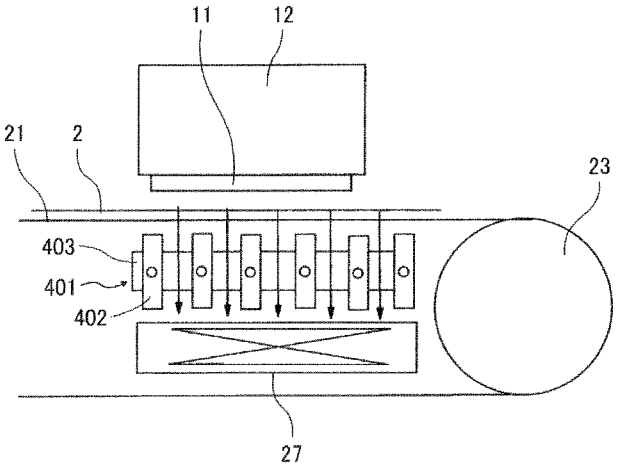
FIG. 25 is a side view of a conveyance unit in a ninth embodiment of the disclosure.

FIG. 25 is a side view of a conveyance unit in the ninth embodiment.

In this embodiment, a flow adjuster 401 is disposed between a protection belt 21 and a suction fan 27. The flow adjuster 401 includes a plurality of straightening plates 402 supported on a shaft member 403.

Figure 26:
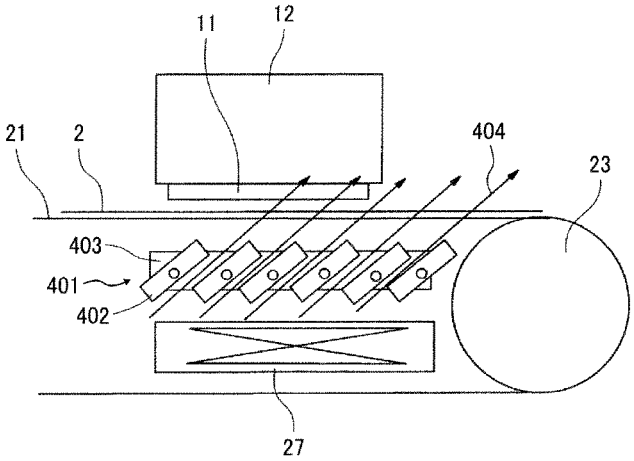
FIG. 26 is a side view of a conveyance unit in a different state from a state of FIG. 25 in the ninth embodiment.

To separate a printing medium 2 from the protection belt 21, the straightening plates 402 of the flow adjuster 401 are inclined toward a discharge side and the suction fan 27 is driven for reverse rotation to blow air as shown in FIG. 26.

In this way, air flows 404 are jetted through suction holes 21*a* of the protection belt 21 and the printing medium 2 become more likely to peel off the protection belt 21.

Next, a tenth embodiment of the disclosure is described with reference to FIGS. 27A and 27B.

Figure 27A:
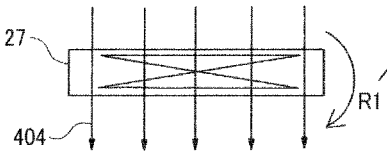
FIGS. 27A and 27B are schematic views a suction fan in a tenth embodiment of the disclosure.
Figure 27B:
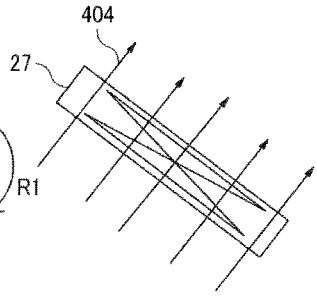

FIGS. 27A and 27B are schematic views of a suction fan 27 in the tenth embodiment.

In this embodiment, the suction fan 27 itself is turned in a direction indicated by arrow R1 into an attitude inclined toward a discharge side as shown in FIG. 27B from a state shown in FIG. 27A and a rotating direction of the fan can be reversed from a suction state into an exhaust state.

In this way, it is possible to obtain similar function and effect to those in the above-described eighth embodiment.

Next, an eleventh embodiment of the disclosure is described with reference to FIGS. 28A and 28B.

Figure 28A:
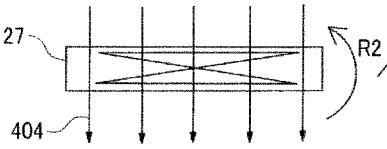
FIGS. 28A and 28B are schematic views of a suction fan in an eleventh embodiment of the disclosure.
Figure 28B:
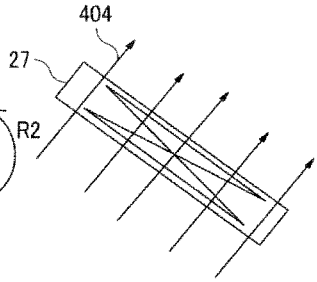

FIGS. 28A and 28B are schematic views of a suction fan 27 in the eleventh embodiment.

In this embodiment, the suction fan 27 itself is turned in a direction indicated by arrow R2 into such an inclined attitude that an exhaust side faces a discharge side as shown in FIG. 28B from a state shown in FIG. 28A.

In this way, it is possible to obtain similar function and effect as those in the above-described eighth embodiment without changing a rotating direction in which the suction fan is driven.

Next, a twelfth embodiment of the disclosure is described with reference to FIG. 29.

Figure 29:
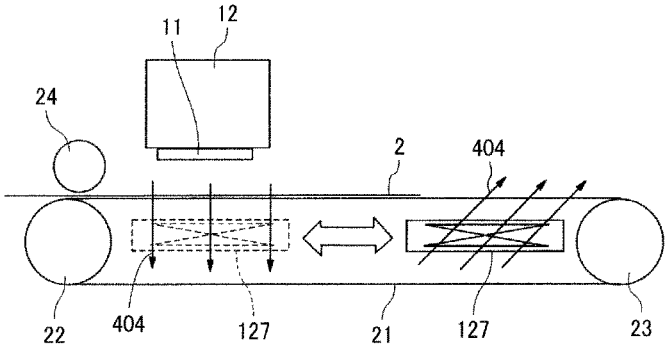
FIG. 29 is a side view of a conveyance unit in a twelfth embodiment of the disclosure.

FIG. 29 is a side view of a conveyance unit in the twelfth embodiment.

In this embodiment, a suction fan 127 is disposed to be movable between a position shown with broken lines and facing an image forming unit 102 and a position shown with solid lines and for jetting air flows toward a leading edge of a printing medium 2. In this case, jetting directions of the suction fan 127 can be changed into directions of the air flows 404 in the position shown with the solid lines.

Next, a first example of a moving assembly of the suction fan in the twelfth embodiment is described with reference to FIG. 30.

Figure 30:
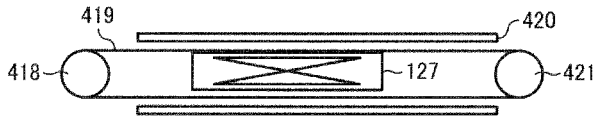
FIG. 30 is a schematic view of a first example of a moving assembly of a suction fan in the twelfth embodiment.

FIG. 30 is a schematic view of the first example of the moving assembly of e suction fan in the twelfth embodiment.

For this example, the suction fan 127 is movably supported by a guide member 420. A belt 419 is connected to the suction fan 127. The belt 419 is looped over a motor 418 and a tension roller 421.

As a result, when the motor 418 is driven for rotation, the suction fan 127 is reciprocally moved via the belt 419.

Next, a second example of the moving assembly of the suction fan in the embodiment is described with reference to FIG. 31.

Figure 31:
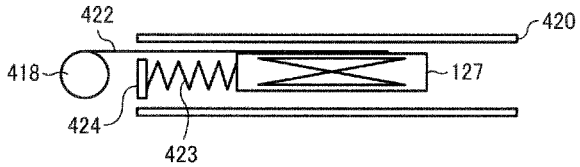
FIG. 31 is a schematic view of a second example of the moving assembly of the suction fan.

FIG. 31 is a schematic view of the second example of the moving assembly of the suction fan in the twelfth embodiment.

For this example, one end of a wire 422 is attached to the suction fan 127. The other end of the wire 422 is connected to the motor 418 so that the wire 422 can be reeled. Also, an elastic member 423 to push the suction fan 127 out to a discharge side is disposed between the suction fan 127 and a fixing portion 424.

As a result, by rotating the motor 418 to loosen the wire 422, the suction fan 127 is moved in a discharge direction due to resilience of the elastic member 423. By rotating the motor 418 in reverse to retract the wire 422, the suction fan 127 is moved to a side facing the image forming unit 102.

Next, a thirteenth embodiment of the disclosure is described with reference to FIG. 32.

Figure 32:
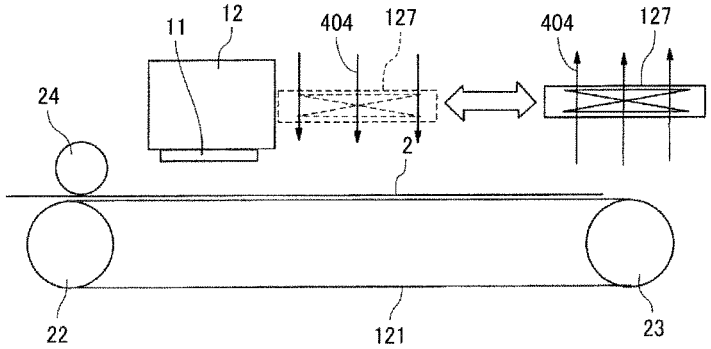
FIG. 32 is a side view of a conveyance unit a thirteenth embodiment of the disclosure.

FIG. 32 is a side view of a conveyance unit in the thirteenth embodiment.

In this embodiment, a fan 127 is provided to be movable between a position shown with broken lines and on a downstream side of an image forming unit 102 in a conveyance direction of a printing medium and a position shown with solid lines above a follow roller 23. As a moving assembly for the fan 127, the moving assembly in FIG. 30 or FIG. 31 can be used.

In this embodiment, the fan 127 is placed at the position shown indicated by the broken lines during printing operation to blow air flows onto a printing medium 2 to push the printing medium 2 against a protection belt 121 and moves to the position shown indicated by the solid lines following movement of the printing medium 2.

Then, when the fan 127 moves to the position shown with the solid lines, the fan 127 is driven for reverse rotation to reverse a direction of the air flows and sucks the printing medium 2 up from the protection belt 121 to separate the printing medium 2 from the protection belt 121.

Next, a fourteenth embodiment of the disclosure is described with reference to FIG. 33.

Figure 33:
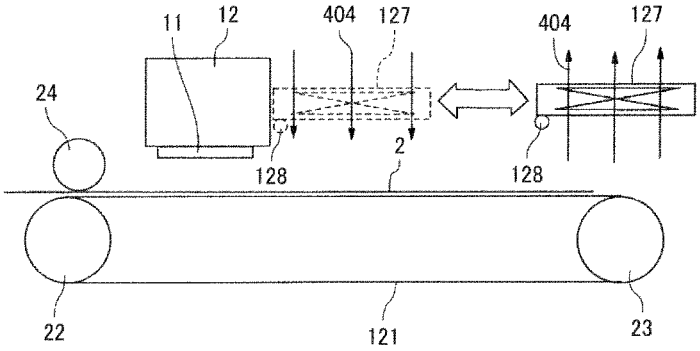
FIG. 33 is a side view to a conveyance unit in a fourteenth embodiment of the disclosure.

FIG. 33 is a side view of a conveyance unit in the fourteenth embodiment.

In this embodiment, a sensor 128 to detect the printing medium 2 is provided on a side of the fan 127 and the fan 127 follows the movement of the printing medium 2 while the sensor 128 senses the printing medium 2 in the above-described thirteenth embodiment.

Next, a fifteenth embodiment of the disclosure is described with reference to FIG. 34.

Figure 34:
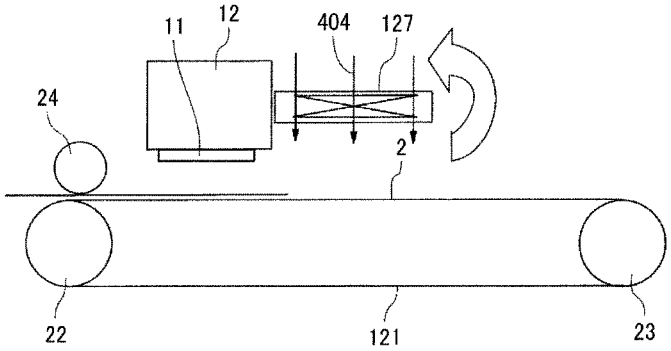
FIG. 34 is a side view of a conveyance unit in a state in a fifteenth embodiment of the disclosure.

FIG. 34 is a side view of a conveyance unit in a state in the fifteenth embodiment.

In this embodiment, a fan 127 is disposed on a downstream side of the image forming unit 102 in a conveyance direction of a printing medium and an attitude of the fan 127 can be changed.

For example, the fan 127 is in such an attitude as to jet air flows directly downward when the printing operation starts and the fan 127 is turned from this attitude and the attitude of the fan 127 is changed as a printing medium 2 is conveyed as shown in FIG. 34.

Figure 35:
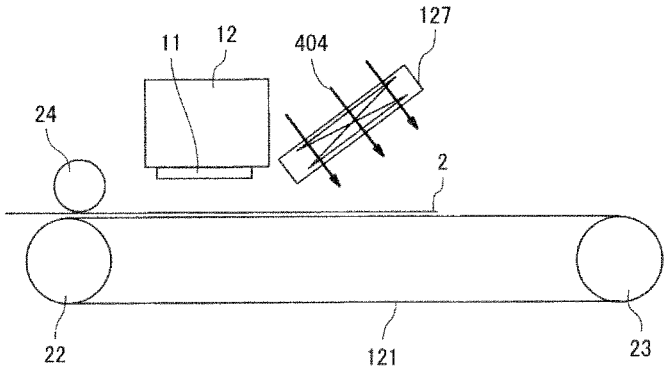
FIG. 35 is a side view of the conveyance unit in another state in the fifteenth embodiment.

Specifically, as shown in FIG. 35, the fan 127 is brought into a diagonally downward attitude and an air volume is increased so that the air flows are blown onto a leading edge of the printing medium 2 to thereby suppress lifting of the printing medium 2.

Figure 36:
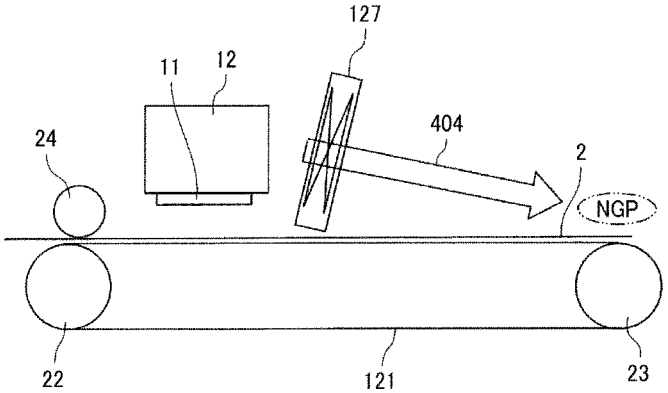
FIG. 36 is a side view of the conveyance unit in still another state in the fifteenth embodiment.

Then, as shown in FIG. 36, when the leading edge of the printing medium 2 moves to a position above the follow roller 23, the fan 127 generates yet stronger air flows 404 to cause a negative pressure above the leading edge of the printing medium 2 to thereby separate the printing medium 2 from the protection belt 21.

According to the above-described ninth to fifteenth embodiments, the single fan can carry out both of operation for bringing the printing medium into close contact with the belt during the printing operation and operation for separating the printing medium from the belt after the printing.

In the above-described embodiments, the conveyance device to convey the printing medium while protecting the adhesive face with the protection belt has been described. However, the conveyance device is not limited to such a structure. For example, in other embodiments, the conveyance device may have the following structures as well.

(1) An image is formed on an adhesive face of a printing medium, and the printing medium is conveyed with a medium face of the printing medium supported on a conveyance belt. (2) A printing medium without an adhesive face is conveyed by a conveyance belt. (3) Without using a belt, a printing medium is conveyed by paired rollers.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

an image forming device to form an image on a printing medium;

a conveyance unit disposed opposing the image forming device to convey the printing medium;

a correction unit to correct an attitude of a leading edge of the printing medium sent out from the conveyance unit; and an attitude controller to control correction of the attitude of the leading edge of the printing medium performed by the correction unit, wherein the attitude controller determines whether or not the correction of the attitude of the leading edge of the printing medium is to be performed, and causes the correction unit to perform the correction when the attitude controller determines that the correction is to be performed and causes the correction unit not to perform the correction when the attitude controller determines that the correction is not to be performed.

2. The image forming apparatus according to claim 1, further comprising an attitude sensor to detect the attitude of the leading edge of the printing medium sent out from the conveyance unit, wherein, based on a detection result of the attitude of the leading edge of the printing medium detected by the attitude sensor, the attitude controller determines whether or not the correction of the attitude of the leading edge of the printing medium is to be performed.

3. The image forming apparatus according to claim 1, wherein the printing medium is a roll-shaped printing medium and the attitude controller determines whether or not the correction of the attitude of the leading edge of the printing medium is to be performed, based on at least one of a type of the printing medium and a roll diameter of the roll-shaped printing medium.

4. The image forming apparatus according to claim 1, wherein the printing medium has an adhesive face with no release paper attached on the adhesive face.

5. The image forming apparatus according to claim 4, wherein the printing medium is conveyed with the adhesive face retained by the conveyance unit.

6. The image forming apparatus according to claim 1, wherein the correction unit is an air-flow generator to generate an air flow toward the leading edge of the printing medium sent out from the conveyance unit.

7. The image forming apparatus according to claim 6, wherein the air-flow generator adjusts at least one of a blowing direction and an air volume of the air flow.

8. The image forming apparatus according to claim 1, wherein the correction unit includes an attitude regulation member disposed on a printing-medium exit side of the conveyance unit at which the conveyance unit sends out the printing medium, and the attitude regulation member is movable back and forth relative to the conveyance unit.

9. The image forming apparatus according to claim 1, wherein the conveyance unit includes a fan to attract the printing medium to a conveyance face of the conveyance unit and the fan also serves as the correction unit to correct the attitude of the leading edge of the printing medium.

10. The image forming apparatus according to claim 1, wherein the conveyance unit includes at least two rollers and a conveyance belt looped over the at least two rollers to convey the printing medium, the conveyance belt having a plurality of suction holes, and wherein the at least two rollers include a hollow roller to support a printing-medium exit side of the conveyance belt at which the conveyance belt sends out the printing medium, the hollow roller has a plurality of holes communicating a hollow inside with an outside of the hollow roller, and the correction unit is a fan to jet air flows out from the plurality of holes of the hollow roller through the suction holes of the conveyance belt.

* * * * *